United States Patent [19]

Okumura

[11] Patent Number: 4,887,591

[45] Date of Patent: Dec. 19, 1989

[54] MIDGET LIFE-SAVING RESPIRATOR GAS TANK APPARATUS

[75] Inventor: Toshiaki Okumura, Osaka, Japan

[73] Assignee: Grace Create Inc., Osaka, Japan

[21] Appl. No.: 224,634

[22] Filed: Jul. 27, 1988

[51] Int. Cl.[4] ..... A62B 7/00

[52] U.S. Cl. ..... 128/205.21; 128/205.24

[58] Field of Search ..... 128/205.21, 201.28, 128/205.24

[56] References Cited

U.S. PATENT DOCUMENTS

| | | | |
|---|---|---|---|
| 2,860,634 | 11/1958 | Duncan et al. | 128/205.21 |
| 2,906,262 | 9/1959 | Braunstein | 128/205.21 |
| 2,970,594 | 2/1961 | Doak | 128/205.21 |
| 3,045,671 | 7/1962 | Updegraff | 128/205.21 |
| 3,326,231 | 6/1967 | Hogg | 128/205.21 |
| 3,358,683 | 12/1967 | Goitein | 128/205.23 |
| 3,776,227 | 12/1973 | Pitesky et al. | 128/205.21 |
| 3,976,063 | 8/1976 | Henneman et al. | 128/205.21 |
| 4,365,628 | 12/1982 | Hodel | 128/205.21 |

FOREIGN PATENT DOCUMENTS

| | | | |
|---|---|---|---|
| 1153781 | 9/1963 | Fed. Rep. of Germany | 128/205.21 |

*Primary Examiner*—David A. Wiecking
*Assistant Examiner*—Aaron J. Lewis
*Attorney, Agent, or Firm*—Edwin E. Greigg

[57] ABSTRACT

A midget respirator gas tank apparatus comprising a plurality of small gas tanks each including a pin-penetrable position. The gas tanks are removably mounted in holders with the pin-penetrable position held in a gas-tight space. A pressure regulator is connected to the holders for communication through gas passages. A pin mechanism is supported in a gas-tight state in one of the holders for perforating one of the gas tanks at the pin-penetrable position. A piston drive pin mechanism is supported in the other holder for perforating the other gas tank under pressure of a respirable gas jetting out the gas tank perforated by the first-mentioned pin mechanism. The pressure regulator regulates the pressure of the respirable gs and supplies the pressure-regulated gas to a mouthpiece.

8 Claims, 3 Drawing Sheets

MIDGET LIFE-SAVING RESPIRATOR GAS TANK APPARATUS

BACKGROUND OF THE INVENTION (1) Field of the Invention

This invention relates to a midget life-saving respirator gas tank apparatus for supplying a respirable gas to a human body over a certain period of time, and more particularly to a midget life-saving respirator gas tank apparatus useful for life-saving purposes in emergency.

(2) Description of the Prior Art

Generally, the respirator gas tank apparatus comprises a high pressure tank and a pressure regulator. The high pressure tank has a relatively large capacity for use over a long time such as 30 minutes or one hour. The apparatus, for example, is used in an underwater operation as an aqualung, or is designed to enable a time-consuming operation at a site tending to cause hypoxia.

Since the known high pressure tank is intended for use in a time-consuming operation, the tank has a large capacity and is very heavy. Aside from the underwater use which receives buoyancy, the tank is too cumbersome to carry or handle. It presents difficulties particularly to females, the aged and children in carrying or handling the apparatus, and is far from being useful in an emergency such as a fire.

Attempts have been made heretofore to provide a compact respirator gas tank apparatus better suited for use in an emergency. However, the pressure regulator includes a primary decompression part adjacent the tank and a secondary decompression part adjacent the mouthpiece, which are apart from each other. Consequently, there is a limit to mere reduction in size of the existing tank apparatus. Thus the apparatus still is relatively large and ill adapted for portable use to be carried all the time. The apparatus remains unfit for practical purposes such as use in an emergency with the additional disadvantage that the tank cannot be maintained in a fresh state constantly.

SUMMARY OF THE INVENTION

In fires in buildings, cave-in accidents in mines, fires in underground shopping streets and subways, and auto accidents in tunnels, far more lives are lost from anoxia or carbon monoxide poisoning than from burning or cave-in crushing. Anoxia and carbon monoxide poisoning are caused within a very short time such as several tens of seconds or several minutes taken for running from a site of fire to an entrance, an emergency exit or other safe places. In view of these facts, the present invention intends to provide a very small life-saving respirator gas tank apparatus useful particularly in emergency for supplying a respirable gas to the human body for a short time.

In order to solve the above problem once and for all, intensive researches have been conducted over years for a small life-saving respirator gas tank apparatus suited for practical use. Such researches have arrived at the present invention, i.e. a midget respirator gas tank apparatus useful as a life-saving device in an emergency for supplying a respirable gas to the human body for a short time. The apparatus is very easy to handle and may be manufactured at low cost.

According to a first aspect of the invention, a midget respirator gas tank apparatus comprises a small respirator gas tank including a pin-penetrable position, a holder for removably retaining the gas tank with the pin-penetrable position held in a gastight state, a pressure regulator connected to the holder for communication through a gas passage, and a pin mechanism supported in a gastight state by the holder for perforating the gas tank at the pin-penetrable position, wherein the pressure regulator is operable to regulate pressure of a respirable gas jetting out of the gas tank perforated by the pin mechanism, the respirable gas being guided under regulated pressure to a mouthpiece.

According to a second aspect of the invention, a midget respirator gas tank apparatus comprises a plurality of small respirator gas tanks each including a pin-penetrable position, holders for removably retaining the gas tanks with the pin-penetrable position held in a gastight state, respectively, a pressure regulator connected to the holders for communication through gas passages, a pin mechanism supported in a gastight state by one of the holders for perforating one of the gas tanks at the pin-penetrable position, and a piston drive pin mechanism operable to perforate the other gas tank by pressure of a respirable gas jetting out of the gas tank perforated by the pin mechanism, wherein the pressure regulator is operable to regulate the pressure of the respirable gas, the pressure-regulated respirable gas being guided to a mouthpiece.

This invention provides a midget tank apparatus having the above construction. The apparatus may be carried in a handbag or other types of bags or in a pocket, or may be arranged in a belt form to be worn around the waist. Since the apparatus is very small and light, the user may run with the mouthpiece on his or her mouth in emergency.

Further, according to this invention, the gas tank is constantly maintained in a gastight state. In emergency, any person can screw in the gas tank or operate the control lever to open the gas tank, whereby the the gastight state of the gas tank is broken simply and easily, and the mouthpiece may be used on his or her mouth.

The gas tank may be a disposable type. Then the tank may be manufactured at low cost through mass production lines with increases in its consumption. Also the tank may be removably attached to the holder for convenience in use.

Since the gas tank is locally perforated with a pin for obtaining a respirable gas from the tank, there is no need for a special, complicated perforating mechanism. Further, the invention provides a simple perforating mechanism for screwing the pin into the gas tank or actuating the pin with a pivotable control lever. Such a mechanism is operable in a reliable way without any trouble in an emergency such as a fire.

The gas tank apparatus according to this invention includes a small respirator gas tank which is perforated to obtain a respirable gas therefrom. The apparatus is light and easy to carry so that anybody can use it without difficulty. The apparatus is therefore very useful for life-saving purposes in an emergency at various sites of fire and various working sites.

The gas tank is removable attached to the holder for convenience of use. For obtaining the respirable gas from the gas tank in an emergency, any person can screw in the gas tank or operate the control lever to open the gas tank, whereby the the gastight state of the gas tank is broken simply and easily, and the mouthpiece may be used on his or her mouth.

The gas tank may be a disposable type. Then the tank may be manufactured at low cost through mass production lines with increases in its consumption. Also the tank may be removable attached to the holder for convenience of use.

Since the gas tank is locally perforated with a pin for obtaining a respirable gas from the tank, there is no need for a special, complicated perforating mechanism. Further, the invention provides a simple perforating mechanism for screwing the pin into the gas tank or actuating the pin with a pivotable control lever. Such a mechanism is operable in a reliable way without any trouble in an emergency such as a fire.

Other advantages of this invention will be apparent from the following description of preferred embodiments to be had with reference to the drawings.

BRIEF DESCRIPTION OF THE DRAWINGS

The drawings illustrate a midget life-saving respirator gas tank apparatus according to this invention, in which.

DESCRIPTION OF THE PREFERRED EMBODIMENTS

Embodiments of the invention will be described in detail hereinafter which comprises two very small respirator gas tanks. However, the invention is not limited to these embodiments.

FIRST EMBODIMENT

Figure 1:
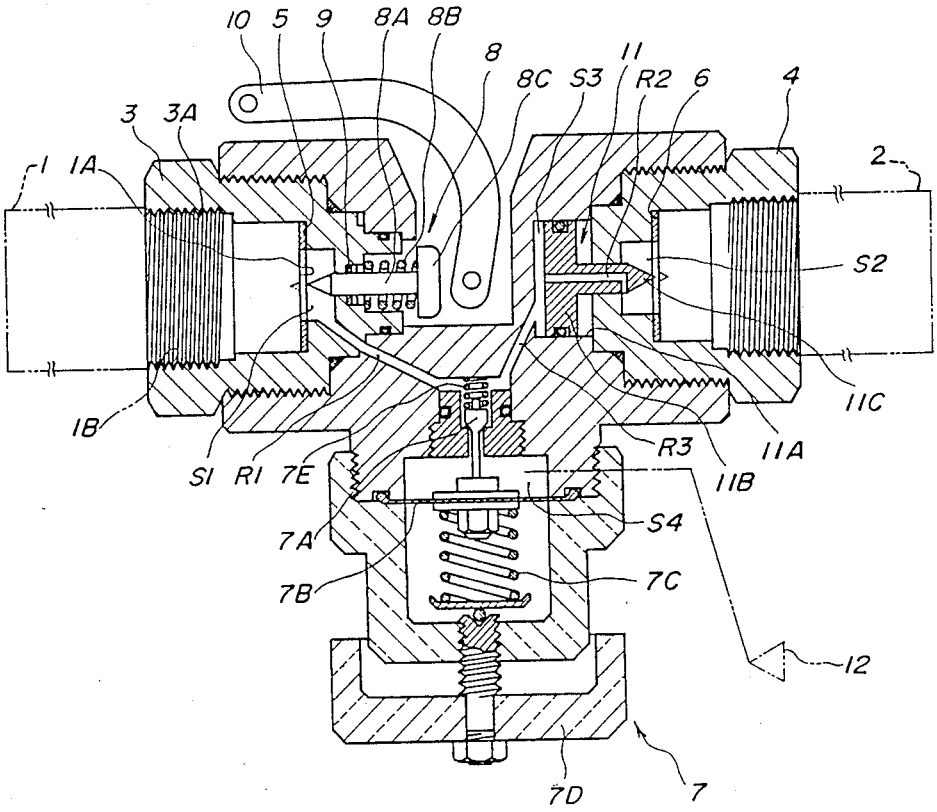
FIG. 1 is a side view, partly in section, of the gas tank apparatus.
Figure 2:
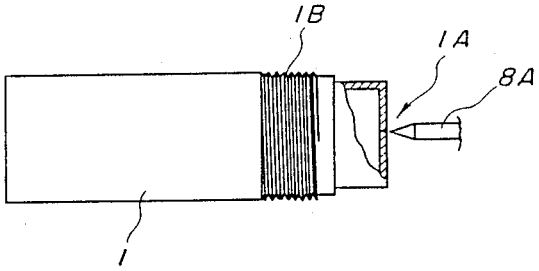
FIG. 2 is a side view, partly broken away, of a tank.

Referring to FIGS. 1 and 2, a midget life-saving respirator gas tank apparatus embodying this invention comprises first and second metallic gas tanks 1 and 2 having a capacity of 100 milliliters and filled with 150–400 kg/cm$^2$ (190 kg/cm$^2$ in this embodiment) of high pressure air.

These tanks 1 and 2 have the same construction and are removably attached to holders in a similar way. Therefore, the first tank 1 will particularly be described for expediency of explanation.

The first tank 1 includes a partition wall at one end thereof defining a pin-penetrable position 1A. The partition is capable of withstanding the internal pressure while being penetrable by a pin 8A. It is desirable that the partition includes a very small area having a smaller material thickness to be penetrated by the pin 8A than the other areas. This facilitates the penetration by the pin 8A.

The first tank 1 defines a threaded portion 1B for meshing with a threaded portion 3A of a first holder 3. Thus, the first tank 1 is removably attached, with the pin-penetrable position 1A maintained gastight, to the first holder 3 arranged back to back with a second holder 4 having an appropriate spacing therebetween.

The gastight coupling between the pin-penetrable position 1A and the first holder 3 is effected through a packing 5 supported between an end of the first tank 1 and an inside surface of the first holder 3 (a packing between the second tank 2 and the second holder 4 being indicated by number 6 in FIG. 1).

A high pressure chamber S1 is defined by the pin-penetrable position 1A and the inside surface of the first holder 3 (the second holder 4 defining a similar high pressure chamber S2).

The first and second holders 3 and 4 are continuous with a common pressure regulator 7. The high pressure chamber S1 of the first holder 3 is in communication with the pressure regulator 7 through a passage R1.

The first holder 3 includes a pin mechanism 8 for penetrating the pin-penetrable position 1A. The pin mechanism 8 includes the pin 8A which has a pointed end, and a spring 8B for biasing the pin 8A away from the pin-penetrable position 1A. The pin mechanism 8 is slidably mounted in a gastight state by means of a seal ring 9.

Figure 3:
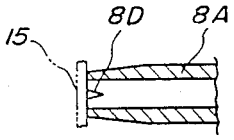
FIG. 3 is a sectional view of an end of a pin in a pin mechanism suited for use in the apparatus according to the invention.

As shown in FIG. 3, the pointed end of the pin 8A defines a cutout 8D. This construction is desirable since, when the small gas tank 1 is perforated with the pin 8A and a punch-out piece 15 is pressed outwardly by the gas pressure, the punch-out piece 15 does not stop a gas passage in the tank 1 opening at the pin end.

Number 10 in FIG. 1 indicates a device for perforating the gas tank 1, which, in the illustrated example, comprises a control lever. The lever is pivotably attached to the holder 1, and has an end opposed to a head 8C of the pin 8A to press the head 8C with a pivotal movement thereof.

Instead of opening the tank 1 by operating the control lever 10, the tank may be screwed against the pin 8A with the pin mechanism 8 fixed to the holder 3. This arrangement will improve sealing of the tank 1 to enable effective use of the respirable gas in the tank 1. It is desirable in this case to fix the tank 1 with a stopper (not shown) for preventing the tank 1 to be screwed in from wobbling or becoming displaced from the right position.

As distinct from the first holder 3 having the pin mechanism 8, the second holder 4 includes a piston drive pin mechanism 11 for opening the tank 2.

The piston drive pin mechanism 11 includes a cylinder 11A defined in the second holder 4, a piston 11B slidably mounted in the cylinder 11A, a pin 11C integral with and extending from a forward end of the piston 11B and having a pointed end, and a passage R2 extending from a base end of the piston 11B along one side thereof to open in the vicinity of the pointed end of the pin 11C.

A cylinder chamber S3 is formed between the piston 11B and inside surfaces of the second holder 4. The passage R3 communicates with the passage R1 in the first holder 3 through the cylinder chamber S3 and the pressure regulator 7.

Thus, the second tank 2 is perforated by the action of the high pressure respirable gas flowing into the cylinder chamber S3 as will be described later.

It is preferable that a cutout 8D is defined in the pointed end of the pin 8A in the piston drive pin mechanism 11 for the same reason as noted hereinbefore.

The pressure regulator 7 comprises a valve member 7A disposed at a junction of the passage R1 of the first holder 3 and the passage R3 of the second holder 4 to be operable by the pressure from the first tank 1, a diaphragm 7B disposed in a decompression chamber S4 and connected to an end of the valve member 7A, a compression spring 7C disposed behind the diaphragm 7B, a handle 7D for adjusting the pressure applied by the compression spring 7C, and a coil spring 7E acting on the valve member 7A in opposed relationship to the compression spring 7C.

When a pressure exceeding a balancing pressure of the diaphragm 7B, namely an inlet pressure, adjusted by means of the handle 7D, is applied to the decompression chamber S4, the compression spring 7C is compressed to draw and close the valve member 7A. Consequently, the respirable gas is supplied under an appropriate constant pressure from the decompression chamber S4 to a decompression chamber (not shown) in a mouthpiece 12 communicating with the decompression chamber S4.

Figure 4:
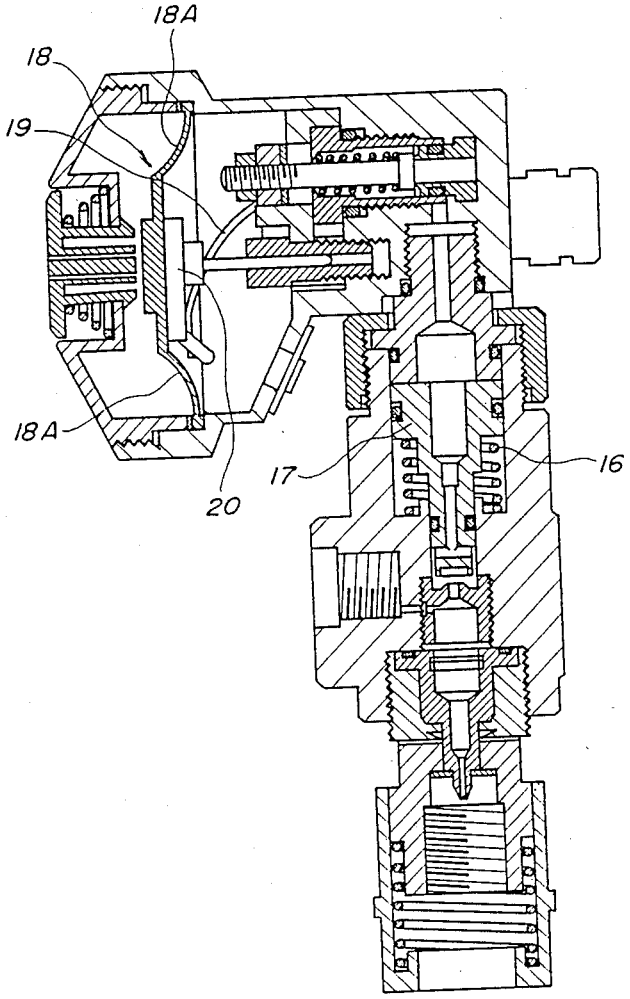
FIG. 4 is a sectional view of a pressure regulator used according to the invention.

According to the present invention, the pressure regulation may be effected, as shown in FIG. 4, by means of a piston 17 provided in the primary decompression side and biased by a spring 16 instead of the foregoing diaphragm 7B. This construction is desirable since the pressure regulator becomes easy to manufacture and may be formed compact. The secondary decompression side includes a diaphragm 18, a detector 19 for detecting a pressure acting on the diaphragm 18, and a shaft 20 for allowing parallel movement of the diaphragm 18. This construction promotes compactness of the pressure regulator. The diaphragm 18 preferably has a curved shape having its periphery 18A extending downwardly for uniform detection of the pressure.

The mouthpiece 12 has a conventional construction and is therefore not particularly described here. The mouthpiece 12 should preferably cover the mouth and nose together, or cover only the mouth with a nose plug provided for preventing breathing through the nose.

The valve member 7A which is open when the first tank 1 is perforated first is temporarily closed under the dynamic pressure of the high pressure respirable gas. At the same time, the dynamic pressure acts through the passage R3 to push the piston 11B in the second holder 4 thereby to perforate the second tank 2.

Thereafter, the gas pressure acts as a substantially static pressure on the diaphragm 7B, to enable the respirable gas to leave the decompression chamber S4 under the inlet pressure initially set by means of the handle 7D.

More than two tanks 1 may be connected to one another to be worn around the waist. The tank 1 may be a very small tank having any selected capacity below 1,000 milliliters.

SECOND EMBODIMENT

Figure 5:
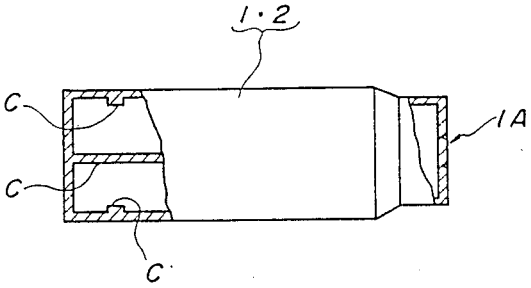
FIG. 5 is a side view, partly broken away, of a modified tank.

As distinct from the first and second tanks 1 and 2 according to the first embodiment, the gas tank shown in FIG. 5 is formed of a hard synthetic resin and has ribbed pressure-proof inside walls C. This tank has a further reduced capacity of 50 milliliters, and includes an irregular pin-penetrable position for perforation by the pin 8A.

This irregular construction allows the synthetic resin, which, unlike a metal, does not undergo plastic deformation by pressing the pin 8A, to locally break under the force of pin 8A.

The tank is removable fitted in the holder 3 by utilizing elastic deformation of the resin instead of the threaded portion 1B.

The holders 3 and 4 and the pressure regulator 7 have the same constructions as in the first embodiment.

The second embodiment using a hard plastic resin has the advantage of low cost.

Two small respirable gas tanks are used in each of the foregoing embodiments, but the number of tanks may be one, three or more.

As will be understood from the description of the first and second embodiments, the first aspect of the present invention has the following features:

The invention is not limited to any specific construction only if the small respirator gas tank is maintained in a gastight state until use, and the gastight state is broken by the pin mechanism. The tank capacity may be varied for intended users or uses, but should generally be up to 1,000 milliliters taking portability and handling easiness into account, preferably below 500 milliliters, and most desirably in the range of 25–350 milliliters.

The gas tank may be disposable after use, or may be repeatedly used by replenishing it with a respirable gas.

To this end, the invention provides a technical solution in which the gas tank is locally penetrable by a pin, and is removably attached to the holder with the pin-penetrable position maintained in gastight state.

The gas tank may be formed of a metal or a hard synthetic resin. Particularly, a high strength hard synthetic resin is a preferred material since the tank will then be manufactured with high productivity, to be lightweight and easy to carry and handle.

In locally perforating the gas tank, the metallic gas tank should preferably include a wall portion having a smaller material thickness than other portions, which is the position to be contacted by the pin and yet withstands the internal pressure.

To be perforated by a pin, the tank has a wall formed of a hard synthetic resin and is designed to withstand a high pressure. The portion of its wall to be perforated may have an irregular structure to be breakable. In short, it will serve the purpose if the wall is capable of being perforated with a pin.

The gas tank may be perforated by screwing the tank into contact with a pin mechanism fixed to the holder. This construction permits the small gas tank to be sealed with increased reliability, for effective use of the respirable gas in the gas tank.

Further, the gas tank may be perforated by a pin movable toward the gas tank. This arrangement may include a control lever pivotable into abutment on a back face of the pin for driving the pin. In this case, it is preferable to utilize the principle of the lever and fulcrum for driving the pin, which facilitates the control operation and drives the pin with a minimal force.

The pin mechanism may include only a pointed pin, or a pointed pin and a spring for biasing the pin away from the gas tank. The pointed pin should preferably define a cutout in a forward end thereof. Then, when the gas tank is perforated and a punch-out piece is pressed outwardly by the high internal gas pressure, the punch-out piece will not clog a gas passage in the tank opening at the forward end of the pin.

The pressure regulator may include a diaphragm, a spring and a handle or, alternatively, a decompression valve such as a needle valve.

The pressure regulator preferably includes a spring-loaded piston to perform a pressure regulating function. Such a regulator has excellent processability and promotes compactness.

The respirable gas filled into the gas tank according to this invention may be atmospheric air, a gas mixture of oxygen and other gases mixed in ratios suited for respiration, or oxygen-enriched air produced by mixing atmospheric air and oxygen. Such a gas preferably is filled into the tank in the pressure range of 150–400 $kg/cm^2$.

According to this invention, the mouthpiece should preferably cover the mouth and nose together, or cover only the mouth with a nose plug provided for preventing breathing through the nose.

As will be understood from the description of the first and second embodiments, the second aspect of the invention has the following features:

The gas tank apparatus comprises a plurality of small respirator gas tanks, and a piston drive pin mechanism operable by pressure of a respirable gas jetting out of a gas tank perforated by the pin mechanism. The piston drive pin mechanism perforates another sealed gas tank. A pressure regulator is provided to regulate the pressure of the respirable gas, and the pressure-regulated respirable gas is guided to a mouthpiece.

The apparatus according to the second aspect of the invention is an improvement upon the apparatus according to the first aspect. The construction of the pin mechanism, the device and method for opening the small gas tanks, the construction at the pointed pin in the pin mechanism, and the pressure regulator may be similar to those in the apparatus according to the first aspect of the invention.

The piston drive pin mechanism employed in the apparatus according to the second aspect of the invention will serve the purpose if operable to open a small gas tank by the pressure of the gas jetting out of another gas tank when the latter is opened by the pin mechanism. In this case, the piston drive mechanism should preferably include a pointed pin defining a cutout in a forward end thereof. Then, when the gas tank is perforated and a punch-out piece is pressed outwardly by the high internal gas pressure, the punch-out piece will not clog a gas passage in the tank opening at the forward end of the pin.

What is claimed is:

1. A midget respirator gas tank apparatus comprising at least first and second gas tank holders for securing thereto at least a first and a second small respirator gas tank, each gas tank including a pin-penetrable end closure means for retaining the gas within the tank in a gas-tight state, a pressure regulator connected to said first and second gas tank holders, gas passages in said apparatus that extend from each of said first and second gas tank holders to said pressure regulator, a first pin mechanism supported in said apparatus in a gastight state relative to said first gas tank holder for perforating said end closure of said first gas tank positioned at a pin-penetrable position in said first gas tank holder, and a piston drive pin mechanism positioned relative to said second gas tank holder and means operable to perforate the end closure of said second gas tank held in said second gas tank holder due to pressure of a respirable gas jetting out of said first gas tank when perforated by said first pin mechanism, wherein said pressure regulator is operable to regulate the pressure of the respirable gas from said first and second gas tanks, the pressure-regulated respirable gas being guided to a mouthpiece from a common chamber in said pressure regulator.

2. A midget respirator gas tank apparatus as claimed in claim 1 wherein said first pin mechanism is fixed to said first holder and includes a pin, and said first and second gas tanks are screwed into said first and second holders to be perforated by the pin.

3. A midget respirator gas tank apparatus as claimed in claim 1 further comprising a control lever for driving said first pin mechanism to perforate said end closure of said first gas tank.

4. A midget respirator gas tank apparatus as claimed in claim 3 wherein said control lever is pivotably attached adjacent to said first holder.

5. A midget respirator gas tank apparatus as claimed in claim 4 wherein said first pin mechanism is fixed to said first holder and includes a pin end defining a cutout.

6. A midget respirator gas tank apparatus as claimed in claim 5 wherein said first pin mechanism includes a pin having a pointed end, and a spring for biasing the pin away from said end closure of said first gas tank.

7. A midget respirator gas tank apparatus as claimed in claim 6 wherein the pressure regulator includes a spring-loaded diaphragm and a handle for adjusting the diaphragm.

8. A midget respirator gas tank apparatus as claimed in claim 7 wherein the pressure regulator includes a spring-loaded piston which performs a pressure regulating function.

* * * * *